US010005528B2

(12) United States Patent
Schaefer

(10) Patent No.: US 10,005,528 B2
(45) **Date of Patent: *Jun. 26, 2018**

(54) PONTOON SHIELDS

(71) Applicant: CASCADE WELLNESS TECHNOLOGIES, INC., Sunriver, OR (US)

(72) Inventor: David Schaefer, Sunriver, OR (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/473,337

(22) Filed: Mar. 29, 2017

(65) Prior Publication Data

US 2017/0203821 A1 Jul. 20, 2017

Related U.S. Application Data

(63) Continuation of application No. 14/745,850, filed on Jun. 22, 2015, now Pat. No. 9,688,368, which is a continuation of application No. 14/592,425, filed on Jan. 8, 2015, now abandoned.

(51) Int. Cl.

| | |
|---|---|
| ***B63B 59/02*** | (2006.01) |
| ***B63B 3/14*** | (2006.01) |
| ***B63B 9/00*** | (2006.01) |
| ***B63B 5/24*** | (2006.01) |
| ***B63B 35/34*** | (2006.01) |

(52) U.S. Cl.

CPC ..... *B63B 59/02* (2013.01); *B63B 3/14* (2013.01); *B63B 5/24* (2013.01); *B63B 9/00* (2013.01); *B63B 35/34* (2013.01)

(58) Field of Classification Search

CPC .. B63B 59/02; B63B 3/14; B63B 9/00; B60R 9/18; B60R 13/04; A47B 95/00; A47B 95/04

USPC ..... 114/219; 293/107, 121, 126, 128; 405/212, 215

See application file for complete search history.

(56) References Cited

U.S. PATENT DOCUMENTS

| | | | |
|---|---|---|---|
| 708,476 | A | 9/1902 | Higgins |
| 1,731,492 | A | 10/1929 | Haase |
| 1,852,240 | A | 4/1932 | Hill |
| 2,117,121 | A | 5/1938 | Urquhart et al. |
| 2,546,396 | A | 3/1951 | Jenkins |
| 2,990,802 | A | 7/1961 | Ong et al. |
| 3,000,021 | A | 9/1961 | Lang |

(Continued)

OTHER PUBLICATIONS

Custom Pontoon Boat Kits etc., Division of Fire & Marine, Inc., http://www.custompontoonboatkitsetc.com/id16.html, downloaded Aug. 14, 2014, 2 pages.

(Continued)

*Primary Examiner* — Lars A Olson

(74) *Attorney, Agent, or Firm* — Leber IP Law; Celia H. Leber

(57) ABSTRACT

The present disclosure relates to pontoon shields. The pontoon shields disclosed herein may, for example, protect pontoons from damage and/or enhance the aesthetic appearance of pontoons. The shields may be fashioned from one or more segments of resilient material configured to attach along a longitudinal aspect of a pontoon. The shields may be fashioned from a single segment, or from one or more segments configured to mate with one another. The shields may be attached to a pontoon, for example, via an adhesive, weld, and/or one or more brackets, or other mechanical means.

18 Claims, 12 Drawing Sheets

(56) References Cited

U.S. PATENT DOCUMENTS

| | | | | |
|---|---|---|---|---|
| 3,179,397 | A | 4/1965 | Cleereman et al. | |
| 3,220,026 | A | 11/1965 | Lichti | |
| 3,290,082 | A | 12/1966 | Fritsch | |
| 3,473,836 | A * | 10/1969 | Halter | B60R 19/18 114/219 |
| 3,950,953 | A * | 4/1976 | Matthews | B63B 59/02 114/219 |
| 3,964,422 | A | 6/1976 | Boyd | |
| 4,235,466 | A | 11/1980 | Mandrik | |
| 4,273,065 | A | 6/1981 | Lindsay et al. | |
| 4,294,478 | A * | 10/1981 | Marquette | B60R 13/04 293/128 |
| 4,343,258 | A | 8/1982 | Belvedere | |
| 4,351,257 | A | 9/1982 | Brown, Jr. | |
| 4,584,958 | A | 4/1986 | Green | |
| 4,617,209 | A * | 10/1986 | Ives | B60R 13/04 293/128 |
| 4,641,999 | A * | 2/1987 | Korbuly | B63B 59/02 114/219 |
| 4,660,497 | A | 4/1987 | Cochran | |
| 4,697,762 | A | 10/1987 | Amey | |
| 4,714,443 | A | 12/1987 | Chaplin | |
| 4,719,952 | A | 1/1988 | Geronimo | |
| 4,724,792 | A | 2/1988 | Cochran | |
| 4,738,215 | A | 4/1988 | McMahon | |
| 4,738,566 | A | 4/1988 | Marthinsen | |
| 4,808,451 | A | 2/1989 | McCue | |
| 4,909,172 | A | 3/1990 | Hamby | |
| 4,946,727 | A | 8/1990 | Kessler | |
| 5,117,764 | A | 6/1992 | Kretzer, Jr. | |
| 5,149,569 | A * | 9/1992 | McCue | A47B 95/043 24/297 |
| 5,269,248 | A | 12/1993 | Lee | |
| 5,313,907 | A | 5/1994 | Hodges | |
| 5,485,801 | A | 1/1996 | Gibbs | |
| 5,575,231 | A | 11/1996 | Metcalf | |
| 5,662,060 | A | 9/1997 | Lemke | |
| 5,701,837 | A | 12/1997 | Harvey | |
| 5,746,146 | A | 5/1998 | Bixel, Jr. | |
| 5,803,010 | A | 9/1998 | Roy | |
| 5,870,965 | A | 2/1999 | Hansen | |
| 5,891,551 | A | 4/1999 | Gibbs | |
| 6,000,353 | A | 12/1999 | De Leu | |
| 6,050,211 | A | 4/2000 | Yamaguchi | |
| 6,148,754 | A | 11/2000 | Sims, Jr. | |
| 6,192,818 | B1 | 2/2001 | Rogers-Smith | |
| 6,227,134 | B1 | 5/2001 | Beckett | |
| 6,234,098 | B1 | 5/2001 | Biedenweg et al. | |
| 6,302,042 | B1 | 10/2001 | Biedenweg | |
| 6,644,229 | B1 | 11/2003 | Davenport | |
| 6,685,395 | B1 | 2/2004 | Busby | |
| 6,758,156 | B1 | 7/2004 | Kobas | |
| 6,863,009 | B1 | 3/2005 | Driver | |
| 6,863,011 | B2 | 3/2005 | Kinkead | |
| 6,871,607 | B2 | 3/2005 | Trepanier | |
| 6,951,181 | B1 | 10/2005 | Lemke | |
| 6,988,457 | B2 | 1/2006 | Tsai | |
| 7,527,454 | B1 * | 5/2009 | Brushaber | E02B 3/26 114/219 |
| 8,029,209 | B2 | 10/2011 | Aschenbach | |
| 8,534,212 | B1 | 9/2013 | Worsley et al. | |
| 8,702,461 | B1 | 4/2014 | d'Offay | |
| 8,789,487 | B2 | 7/2014 | Lizzio | |
| 8,939,419 | B2 * | 1/2015 | Wallace | B32B 7/02 248/345.1 |
| 9,688,368 | B2 * | 6/2017 | Schaefer | B63B 59/02 |
| 2004/0134407 | A1 | 7/2004 | Gursoy | |
| 2004/0200397 | A1 | 10/2004 | Klein | |

OTHER PUBLICATIONS

Vantage Resource Group LLC, http://www.vantageprotectionproducts.com/pontoon-guard, downloaded Jun. 19, 2015, 4 pages—Applicant does not concede that any of the subject matter of the foregoing document constitutes prior art, and the citation thereof is not intended to be nor interpreted as an admission that the foregoing constitutes prior art.

Solwold, Ross, "Vantage Resource Group Aligns with 3M as a National Development Partner to Distribute Protection Film to the Marine Industry", Vantage Resource Group, www.vantageresourcegroup.com, Jan. 21, 2010, 1 page.

Dock Edge Boat Shield—http://www.overtons.com/modperl/product/details.cgl?pdesc=Dock-Edge-Boat-Shield&i=35676, downloaded Jun. 19, 2015, 5 pages.

Dockmate Straight Dock Bumper—http://www.overtons.com/modperl/product/details.cgl?pdesc=Dockmate-Straight-Dock-Bumper&i=87174, downloaded Jun. 19, 2015—5 pages.

Dockmate Universal 3-Way Dock Fender—http://www.overtons.com/modperl/product/details.cgi?desc=Dockmate-Universal-3-Way-Dock-Fender&i=71948&r=view, downloaded Jun. 19, 2015, 4 pages.

Plastimo Bumper Dock Fender—Large ½Round Air Filled—Defender Industries, Inc.—http://www.defender.com/product.jsp?path=-1|2276155|2276163&id=2550704, downloaded Jun. 19, 2015, 2 pages.

Custom Pontoon Boat Kits etc., Division of Fire & Marine, Inc., http://www.custompontoonboatkitsetc.com/id16.html, archived at web.archive.org on May 28, 2009, 2 pages.

Vantage Resource Group LLC, http://www.vantageprotectionproducts.com/pontoon-guard, archived at web.archive.org on Oct. 20, 2014, 4 pages—Applicant does not concede that any of the subject matter of the foregoing document constitutes prior art, and the citation thereof is not intended to be nor interpreted as an admission that the foregoing constitutes prior art.

Dock Edge Boat Shield—http://www.overtons.com/modperl/product/details.cgl?pdesc=Dock-Edge-Boat-Shield&i=35676, archived at web.archive.org on Nov. 14, 2013, 5 pages.

Dockmate Straight Dock Bumper—http://www.overtons.com/modperl/product/details.cgl?pdesc=Dockmate-Straight-Dock-Bumper&i=87174, archived at web.archive.org on May 20, 2012—5 pages.

Dockmate Universal 3-Way Dock Fender—http://www.overtons.com/modperl/product/details.cgi?desc=Dockmate-Universal-3-Way-Dock-Fender&i=71948&r=view, archived at web.archive.org on May 25, 2013, 4 pages.

Plastimo Bumper Dock Fender—Large ½Round Air Filled—Defender Industries, Inc.—http://www.defender.com/product.jsp?path=-1|2276155|2276163&id=2550704, downloaded Jun. 19, 2015, unknown publication date but conceded to be prior art, 2 pages.

"Some Critical Issues for Injection Molding", Dr. Jian Wang (Ed.), ISBN: 978-953-51-0297-7, InTech, Available from: http://www.intechopen.com/books/somecritical-issues-for-injection-molding/properties-of-injection-molded-high-density-polyethylene-nanocompositesfilled-with-exfoliated-graph, 282 pages (Mar. 23, 2012).

"Co-Injection Process: Technical Challenges and Solutions", Shih-Po Sun, Ph.D., 2012 Moldex3D R11 European Webinar Series, 75 pages (2012).

* cited by examiner

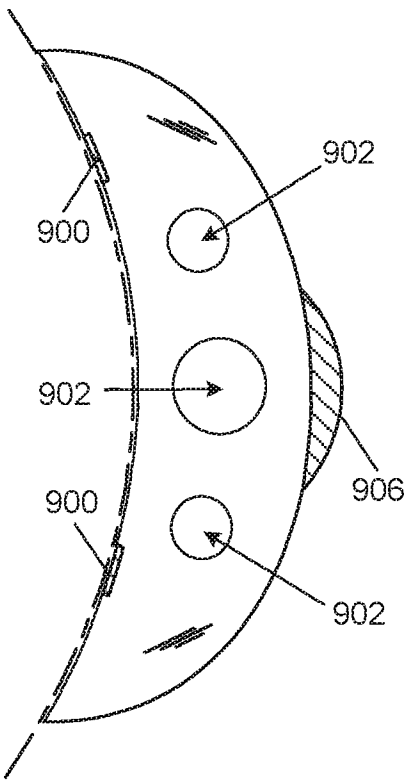
FIG. 9A
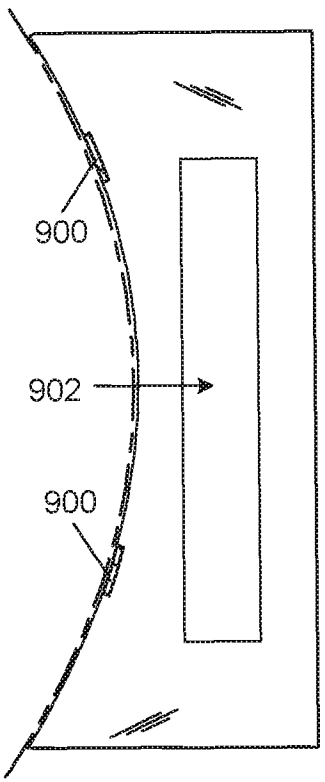
FIG. 9B
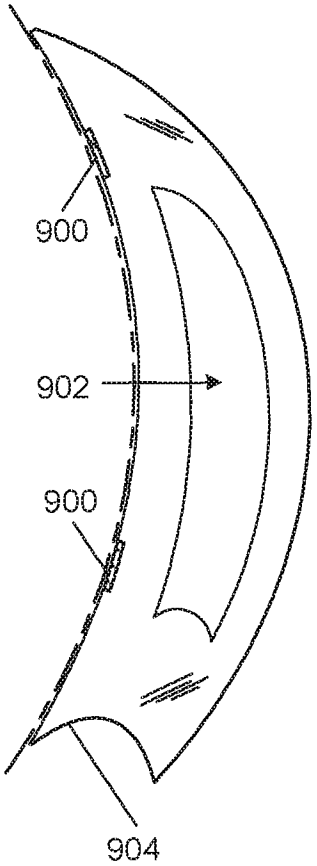
FIG. 9C
FIG. 9D

PONTOON SHIELDS

RELATED APPLICATIONS

This application is a continuation application of U.S. application Ser. No. 14/745,850, filed Jun. 22, 2015, which is a continuation application of U.S. application Ser. No. 14/592,425, filed Jan. 8, 2015, the complete disclosures of which are hereby incorporated by reference into this application.

BACKGROUND

The present disclosure relates to pontoon shields. The pontoon shields disclosed herein may, for example, protect pontoons from damage and/or enhance the aesthetic appearance of pontoons. A pontoon is a watertight float used to provide buoyancy for a water-going vessel or other floating object. For example, a popular application for pontoons is for pontoon boats. A pontoon boat generally includes two or more pontoons which support a deck that, in turn, accommodates passengers and/or cargo. Pontoons may also be used to provide buoyancy for a seaplane, barge, raft, houseboat or ferry, or for a fixed platform such as a dock, floating bridge, derrick, or for other stationary floating objects.

Pontoons are susceptible to damage from impacts with other objects such as docks, pilings, other watercraft, trailers, and the like. The deck of a pontoon boat may provide some protection from impacts if the deck extends outward beyond the edge of pontoons, but even so, the sides of the pontoons remain exposed to objects closer to the waterline or that might extend beneath the deck to impact the pontoon. Some attempts have been made to provide protection for pontoons; for example, U.S. Pat. Nos. 6,758,156 and 8,534,212 disclose pontoon boat fenders that extend downward from the deck of a pontoon boat over a portion of the pontoon. Similarly, conventional marine fenders may be draped over the side of a pontoon boat. Such fenders, however, are incapable of protecting a pontoon from objects that may impact the pontoon aside from the fender's placement, or at unexpected times when the fender is not in position. Further, the use of such fenders would be impractical with some pontoon applications, such as in seaplanes, where fenders would interfere with aerodynamics. There is therefore a need for pontoon shields that provide enhanced protection from impacts and which are suitable for a broader range of applications.

Additionally, some pontoons may have previously accumulated minor yet unsightly damage, such as dents, punctures, scrapes, and other wear and tear, due to previously having lacked adequate protection from impacts with various objects. Such damage may be difficult or expensive to repair. In some situations, it may be cost prohibitive to repair even minor damage to pontoon, and some repairs may be as equally unsightly as the original damage sought to be repaired. For example, repair of an aluminum pontoon typically requires cutting away the affected area and welding in a replacement section. Damage, wear and tear, or repairs therefore tend to accumulate along the longitudinal aspect of pontoons, where impacts frequently occur. Accordingly, there is further a need for pontoon shields configured to conceal damage, wear and tear, such as dents and scrapes, or visible repairs such as welds or grinder marks.

These needs are addressed by the present disclosure.

SUMMARY

A summary of certain embodiments disclosed herein is set forth below. It should be understood that these aspects are presented merely to provide the reader with a brief summary of certain embodiments and that they are not intended to limit the scope of the present disclosure. It should be understood that the various features of the exemplary pontoon shields disclosed herein may be implemented alone, together, or in combination with one another or other features known in the art. The pontoon shields disclosed herein may be effective to absorb an impact, conceal damage to a pontoon, conceal a repair to a pontoon, deflect water, and/or provide an aesthetic enhancement to a pontoon.

In some embodiments, a pontoon shield is fashioned from one or more segments of resilient material configured to attach along a longitudinal aspect of a pontoon. A pontoon shield may be fashioned from a single segment, or from one or more segments configured to mate with one another. The segments of a pontoon shield may include a front segment, at least one mid-segment, and a rear segment. In some embodiments, one of the segments may be cut to size from a length of material, for example, from a roll.

The pontoon shields disclosed herein may be attached to a pontoon via a variety of attachment means. In some embodiments, a pontoon shield or segments thereof may be attached to a pontoon by means of an adhesive, weld and/or one or more brackets, or other mechanical means. Channels or sockets to receive the bracket may be provided in the pontoon shield or segments thereof. The channels or sockets may have any cross-sectional shape effective to secure the pontoon shield to the pontoon, such as curvilinear, circle, L-shaped, T-shaped, or Y-shaped. In some embodiments, a pontoon shield or segments thereof may be removable after having been installed on a pontoon.

The pontoon shields disclosed herein may be constructed from a number of resilient materials, including natural or synthetic rubbers, polymers, ceramics, plastics, composites of any of the foregoing, and co-molded combinations of any of the foregoing. In some embodiments, a pontoon shield or segments thereof may be reinforced with an abrasion resistant material and/or a substantially inductile material.

Various configurations of pontoon shields are disclosed herein. In some embodiments, a pontoon shield or segments thereof may have a low profile configuration. In some embodiments, a pontoon shield or segment thereof may have a concave inner surface configured to form a concavity defined by the adjoining surface of the pontoon. In some embodiments, one or more chambers may be provided within the body of the pontoon shield or segment thereof. Some pontoon shields or segments thereof may include a splash deflector. An abrasion resistant or substantially inductile material may be positioned so as to outwardly bisect the resilient material, for example, to function as a rub-guard.

In some embodiments, a pontoon shield or segments thereof may be fashioned in the form of a skin configured to wrap at least a portion of the pontoon. The skin may be configured to wrap one or more of a lower aspect, an upper aspect, a longitudinal aspect, a front aspect, and/or a rear aspect of a pontoon. In some embodiments, the skin may be configured to be removably attached to the pontoon by means of one or more brackets or other mechanical means.

The foregoing summary may contain simplifications, generalizations, inclusions, and/or omissions of detail; consequently, those skilled in the art will appreciate that the summary is illustrative only and is not intended to be in any way limiting. In addition to the illustrative aspects, embodiments, and features described above, further aspects, embodiments, and features will become apparent by reference to the drawings, the following detailed description of exemplary embodiments, and the claims.

DESCRIPTION OF THE DRAWINGS

FIGS. 9A-D are cross-sectional views of additional exemplary embodiments of a pontoon shield or segment thereof.

DETAILED DESCRIPTION OF EXEMPLARY EMBODIMENTS

Figure 1:
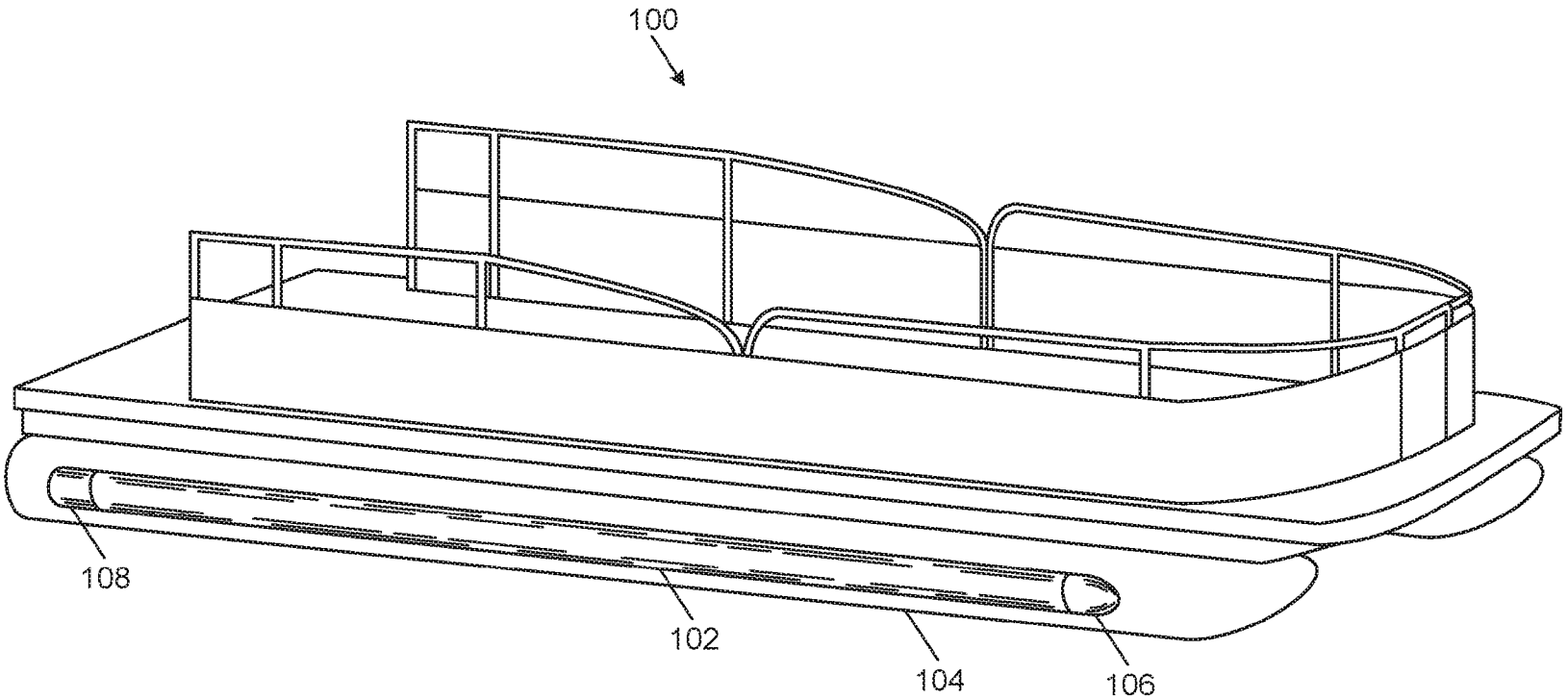
FIG. 1 is a perspective view of a pontoon boat having an exemplary embodiment of a pontoon shield installed thereon.

In the following detailed description of exemplary embodiments, pontoon shields will be described in greater detail with reference to the accompanying figures. Numerous specific details are set forth in order to provide a thorough understanding of the disclosed pontoon shields. It will be apparent, however, to one skilled in the art that the presently disclosed pontoon shields may be provided without some or all of these specific details. In other instances, well known aspects have not been described in detail in order to not unnecessarily obscure the present disclosure. The following detailed description of exemplary embodiments is therefore not to be taken in a limiting sense, and it is intended that other embodiments are within the scope of the present disclosure.

Pontoons

The pontoon shields disclosed herein are suitable for use with a wide variety of pontoon applications, as well as for use with other watercraft or vessels. Pontoon shields may be provided for various water-going vessels that utilize pontoons for buoyancy, for example, pontoon boats, seaplanes, barges, rafts, houseboats, and ferries. Pontoon shields may also be provided for pontoons used to provide buoyancy for various stationary floating objects such as docks, platforms, floating bridges, derricks, barriers, booms, and the like. Likewise, the pontoon shields disclosed herein may be used on pontoons of various shapes, sizes, and materials.

Pontoons tend to be configured in the form of a cylinder having a longitudinal aspect that is several multiples longer than the cross-sectional aspect of the pontoon. The cross-sectional aspect of a pontoon is typically round, oval, or u-shaped, yet rectangular and other desired geometry may also be provided. The cross-sectional aspect of a pontoon generally ranges from between about 14 to 36 inches wide. The longitudinal aspect of a pontoon tends to range from about 6 feet to 40 feet long. Other pontoon shapes or configurations may also be provided, such as modular or barrel-shaped pontoons which may be sequentially secured to one another to provide a buoyancy area having a desired length and width. The pontoon shields disclosed herein may be configured to fit virtually any pontoon configuration.

A wide variety of materials may be used in the construction of pontoons. In some embodiments, pontoons may be constructed from various rolled aluminum alloys, such as 5052 marine-grade aluminum or 5086 salt-water grade aluminum. The thickness of the aluminum used for the construction of pontoons may vary depending on the application. For example, most aluminum pontoons are constructed from 0.100 gauge material. By comparison, 0.080 gauge aluminum may be used in light-duty applications, and 0.125 gauge or thicker material may be used in heavy-duty applications. In some embodiments, pontoons may be constructed from sealed cylinders such as pipes or barrels, or fabricated as boxes having a rectangular shape or other desired geometry.

In some embodiments, pontoons may be constructed from plastic, rubber, elastomers, fiberglass or other non-metal materials. For example, modular pontoons tend to be constructed from plastic, as do pontoons for salt water applications. Plastic pontoons may be constructed from medium density polyethylene. Some pontoons may be filled with closed cell polyurethane foam, for example, for structural stability. In some embodiments, inflatable pontoons may be provided.

Inflatable pontoons may be constructed, for example, from polyvinyl chloride fabric or elastomer-coated or plastic-coated fabrics, such as chlorosulfonated polyethylene synthetic rubber. While some such non-metal pontoons may exhibit a greater degree of resiliency and resistance to dents than aluminum pontoons, the pontoon shields disclosed herein may nevertheless provide advantages in the form of protection from impacts, such as punctures or unsightly scrapes and other wear and tear. The pontoon shields disclosed herein may also provide aesthetic enhancements to non-metal pontoons.

Pontoon Shields

Various features of pontoon shields in accordance with the present disclosure will now be discussed with reference to the accompanying figures. FIG. 1 shows a pontoon boat 100 having an exemplary pontoon shield 102 attached along a longitudinal aspect of a pontoon 104. A pontoon shield may be configured to absorb impacts and otherwise protect the pontoon from damage such as dents, scrapes, or punctures and other wear and tear. Alternatively or in addition, a pontoon shield may enhance the aesthetic appearance of a pontoon. The shield may conceal existing damage, wear and tear or repairs, or the shield may itself exhibit an aesthetic characteristic that enhances the appearance of the pontoon.

A pontoon shield is typically intended to be positioned about a region of the pontoon that is expected to make contact with another object. In some embodiments, the shield may be positioned along the longitudinal axis of the pontoon, for example, in a substantially parallel orientation to such axis. For pontoons having a round, oval, curvilinear, or multi-faceted cross-section, a pontoon shield may be centered or aligned along the longitudinal axis defined by the outward-most tangent or corner of the pontoon's cross-sectional aspect. Such axis may represent the leading point of impact for the longitudinal aspect of the pontoon. For pontoons having a rectangular or otherwise flat cross section, a pontoon shield may be positioned at any impact-prone location, for example, at about the location where docks, pilings, watercraft, trailers, and other objects may likely impact the pontoon. A pontoon shield may also be positioned in a substantially parallel orientation with the axis defined by the waterline of the pontoon, which orientation may diverge from the longitudinal centerline of the pontoon where the forward section of the pontoon rides higher in the water than the aft section. Additionally, a pontoon shield may be positioned such that the lower edge of the shield is at, above, or below the pontoon's waterline.

Pontoon shields may be fashioned from any material effective to protect a pontoon from impacts. In some embodiments, a pontoon shield is fashioned from resilient material, such as elastomers, natural or synthetic rubbers, polymers, ceramics, or plastics. Resilience is the ability of a material to return quickly to its original shape after temporary deflection. Generally, a material having a Shore Hardness of greater than 30 Shore A, for example, between 50 to 95 Shore A, may be suitable for use as a resilient material in a pontoon shield. Shore Hardness can be measured using ASTM testing method D2240. Exemplary resilient elastomers include polyurethane, polyethylene, polypropylene, polyvinyl chloride, butadiene, and hydrogenated nitrile rubber. In addition to resilience, a material may be selected for its tensile strength, abrasion resistance, and elasticity.

In some embodiments, a composite of two or more materials may be provided, or two or more materials may be co-molded, to provide varying properties along different aspects of the shield. For example, a pontoon shield may have a first layer comprising a resilient material and a second layer comprising a substantially inductile material. A substantially inductile material includes any material that exhibits a resistance to deflection that is greater than the resistance to deflection of one or more resilient materials from which a pontoon shield or segment thereof is fashioned. In some embodiments, the resilient material of the first layer may have a hardness value that is less than the hardness value of the substantially inductile material of the second layer. In such co-molded embodiments, the resilient nature of the first layer provides shock absorbing features, while the substantially inductile nature of the second layer may provide resistance to deflection, structural integrity and/or abrasion resistance properties. In some embodiments, substantially inductile material may be located about one or more aspects of a pontoon shield where structural reinforcement may be desired, for example, about attachment points where the pontoon shield is configured to be attached to a pontoon, or where segments of a pontoon shield are configured to mate with one another. Additionally, or in the alternative, a substantially inductile or abrasion resistant material may be located about an outward-facing aspect of a pontoon shield, to provide added protection where the pontoon shield may be expected to scrape or rub against another object.

The substantially inductile material may be selected from among elastomers, natural or synthetic rubbers, polymers, ceramics, or plastics having a relatively greater degree of inductility or hardness than that of one or more resilient materials selected for a pontoon shield. Generally, a material having a Shore Hardness of greater than 50 Shore A, for example, between 65 to 95 Shore A or more, may be suitable for use as a substantially inductile material in a pontoon shield. Exemplary substantially inductile elastomers include polyurethane, polyethylene, polypropylene, polyvinyl chloride, butadiene, and hydrogenated nitrile rubber having a relatively greater degree of inductility or hardness than that of one or more resilient materials selected for the pontoon shield. In some embodiments, blends or composites of substantially inductile materials and/or resilient materials may be provided. In some embodiments, the substantially inductile material may nevertheless exhibit certain resilient properties, particularly when fashioned from elastomers, natural or synthetic rubbers, or plastics.

In some embodiments, the substantially inductile material may comprise a metal, such as an aluminum alloy, stainless steel, or other metal alloy. For example, a pontoon shield may be provided having a resilient material co-molded with a metal alloy, such that the metal alloy aspects enhance the structural integrity, durability, or wear-resistance of the shield.

In addition to resilience or inductility, a material may be selected for various other desired properties, including elasticity, tensile strength, and/or abrasion resistance. Elasticity is the ability of a material to return to its original shape and size after being stretched, compressed, twisted, or bent. Abrasion resistance of elastomers may be quantified using ASTM test method D2228. Exemplary abrasion resistant elastomers include butadiene, hydrogenated nitrile rubber, and polyurethane. Other exemplary abrasion resistant materials include metals, such as aluminum alloys or stainless steel alloys. In some embodiments, two or more materials may be blended, for example, to provide a combination of specific properties. The particular material or combination thereof may be selected based on known properties of various materials and the desired characteristics of the particular pontoon shield.

The pontoon shields disclosed herein may be configured to cover any desired aspect of a pontoon's surface, for example, any surface which may be prone to incur impacts with other objects. Typically, a pontoon shield is configured to span length-wise along a longitudinal aspect of a pontoon. A pontoon shield is generally intended to be attached to a pontoon along the leading point of impact for the longitudinal aspect of the pontoon. The height and/or thickness of the shield are typically configured to provide adequate impact protection, although additional height may be provided to further conceal damage, wear and tear or repairs, and/or to provide enhanced impact protection, such as impacts from protruding objects which may not necessarily contact the leading edge of the pontoon's longitudinal aspect.

As shown in FIG. 1, pontoon shield 102 spans the substantial length of the pontoon's longitudinal aspect. Pontoon 104 is about 25 feet long, and pontoon shield 102 measures about 20.5 feet in length and about 12 inches in height. Front segment 106 and rear segment 108 provide an aesthetic termination to the respective ends of the shield.

The length of a pontoon shield may span a longitudinal aspect that is less than or about equal to the entire length of the pontoon. For example, a pontoon shield may span a longitudinal aspect of a pontoon such that the shield has a length between about 5% to 100% of the length of the pontoon. In some embodiments, a pontoon shield may span between about 50% to 95%, about 65% to 95%, or about 75% to 85% of the length of the pontoon. In some embodiments, multiple pontoon shields may be spaced along a longitudinal aspect of a pontoon, with each such shield spanning a length that is between about 1% to 50% of the length of the pontoon, for example, about 1% to 5%, 5% to 10%, 10% to 25%, or 25% to 50% of the length of the pontoon.

The height of a pontoon shield may span around all or any portion of the cross-sectional circumference or perimeter of a pontoon. For example, a pontoon shield may span between about 1% to 100% of a pontoon's circumference or perimeter, e.g., between about 1% to 5%, about 5% to 10%, about 10% to 25%, about 25% to 50%, about 50% to 75%, or about 75% to 100%.

The pontoon shields disclosed herein may provide different features depending on their height relative to the diameter of a pontoon. In some embodiments, a pontoon shield may be configured to provide only a thin strip of protection, for example, along an axis expected to coincide with the leading point of impact for the longitudinal aspect of the pontoon (e.g., the axis defined by the outward-most tangent or corner of the pontoon's cross-sectional aspect) or other impact-prone location. Such a thin pontoon shield may provide a sleek look, while remaining effective to protect a pontoon from some impacts, such as from docks, pilings, trailers, and other relatively flat-surfaced objects. In some embodiments, such a thin strip of protective material may be sufficient to protect a pontoon from damage, wear, and tear. Accordingly, the height of a pontoon shield may in some embodiments be only a few inches or less, e.g., between about 0.5 to 1 inch, about 1 to 2 inches, or about 2 to 3 inches.

In some embodiments, a pontoon shield may be between about 3 to 12 inches tall, for example, about 3 to 5 inches, about 5 to 7 inches, about 7 to 9 inches, or about 9 to 12 inches. Such a pontoon shield may provide added protection against impacts from protruding objects which may not necessarily contact the leading edge of the pontoon's cross-sectional aspect, and/or may conceal damage, wear and tear, or repairs, which may tend to accumulate within a general region across the pontoon's longitudinal aspect.

In some embodiments, a pontoon shield may be configured to wrap around the substantial portion of the outward-facing and/or bottom surface of the cross-sectional circumference or perimeter of a pontoon. In some embodiments, a pontoon shield may be configured to be positioned on the bottom surface of the pontoon, for example, to protect the pontoon from impacts due to submerged objects or shallow waters.

In some embodiments, a pontoon shield may provide protection for a bow and/or stern aspect of a pontoon. Bow and/or stern protection may be provided by separate shields in accordance with the present disclosure, which may be used alone or in combination with one or more shields designed for a longitudinal aspect of a pontoon. Bow and/or stern segments may also be configured to mate with longitudinal segments. Alternatively, bow and/or stern protection may be provided by a longitudinal pontoon shield configured to span beyond the length of the pontoon and, for example, wrap around at least a portion of a bow aspect and/or a stern aspect of the pontoon.

Figure 2A:
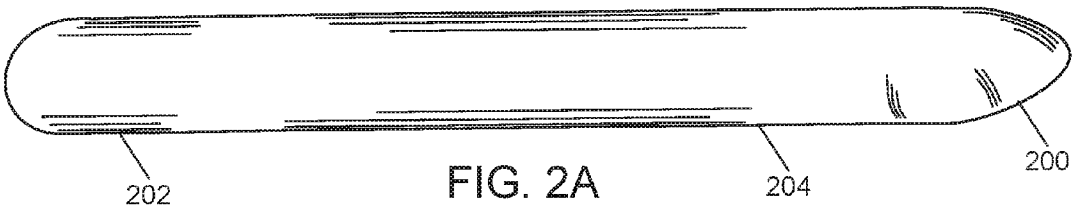
FIG. 2A is a perspective view of an exemplary embodiment of a pontoon shield.
Figure 2B:
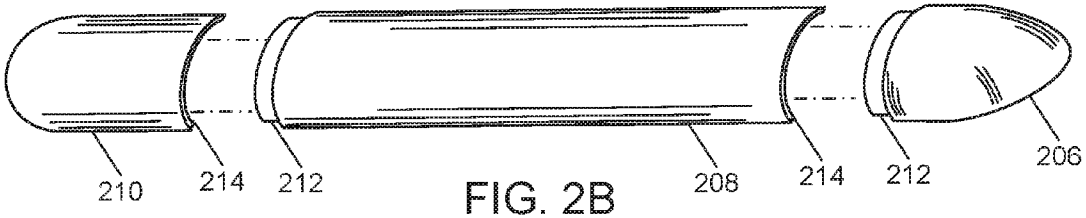
FIG. 2B-C are exploded, perspective views of exemplary embodiments of a pontoon shield having multiple segments that mate to one another.
Figure 2C:
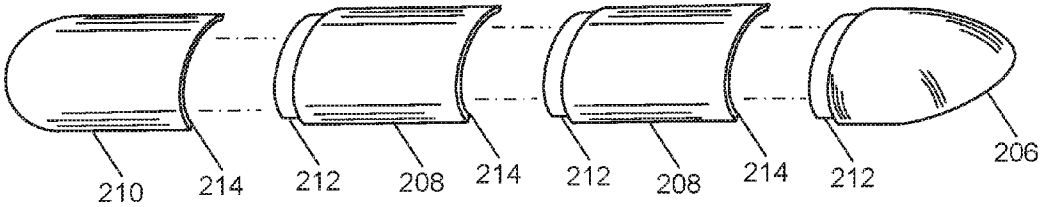
Figure 2D:
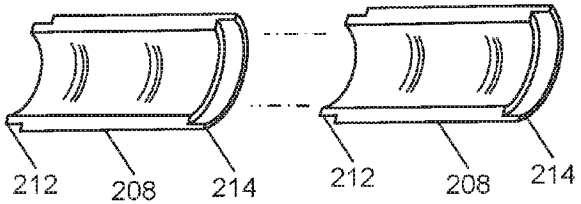
FIG. 2D is an exploded, perspective view of the inward aspect of an exemplary embodiment of segments of a pontoon shield that mate to one another.

With reference to FIGS. 2A through 2D, the pontoon shields disclosed herein may be provided as single segment, for example, as a pre-fabricated shield (FIG. 2A), or alternatively, as multiple segments configured to mate to one another (FIGS. 2B through 2D). As shown in FIG. 2A, a pontoon shield may comprise a front segment 200 and a rear segment 202, each of which being integrated with a mid-segment 204 to provide a complete shield. In some embodiments, a pontoon shield such as the shield of FIG. 2A may be provided in which the shield has a pre-determined length corresponding to a pontoon for which the shield is intended to be installed. For example, one-piece pontoon shields may be provided having a length ranging from about 4 to 30 feet long, e.g., about 4 to 8 feet, about 8 to 12 feet, about 12 to 16 feet, about 16 to 20 feet, about 20 to 24 feet, about 24 to 26 feet, about 26 to 28 feet, about 28 to 30 feet long, or longer, so as to correspond to a specified pontoon for which the shield is intended to be installed.

As shown in FIGS. 2B through 2D, a pontoon shield having multiple segments may be provided, for example, comprising a front segment 206, one or more mid-segments 208, and a rear segment 210. Each segment may be configured to mate with another segment, for example via a male end 212 and a female end 214 configured to receive the male end. The terminal ends of the front segments and rear segments may have any desired shape, such as a curved, pointed, blunt, or conical shape. In some embodiments, the front segment may have a relatively pointed curve and the rear segment may have a relatively blunt curve.

Figure 3A:
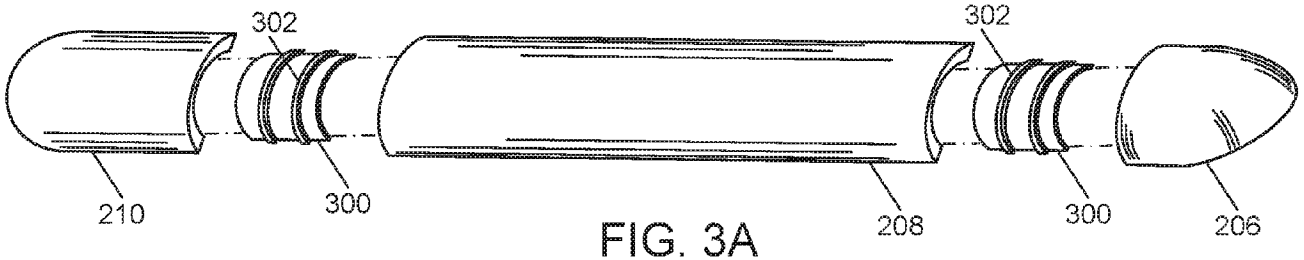
FIGS. 3A and 3B are exploded, perspective views of exemplary embodiments of a pontoon shield having segments that mate to one another via coupling elements.
Figure 3B:
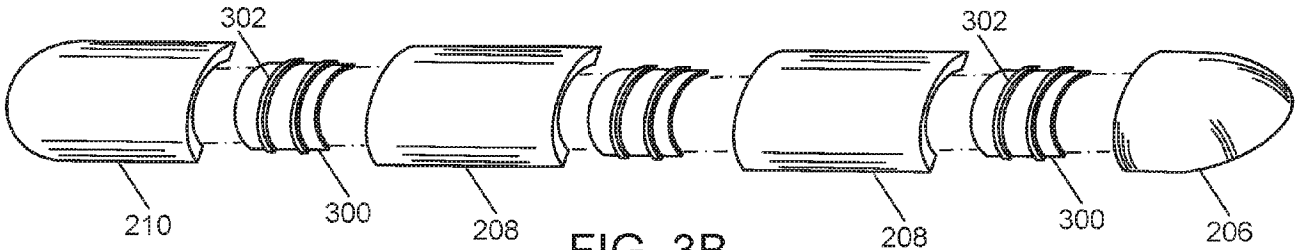
Figure 3C:
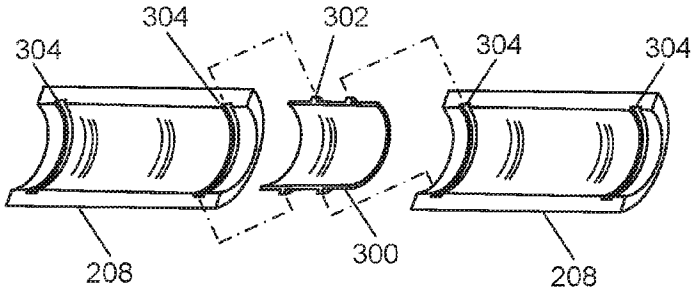
FIG. 3C is an exploded, perspective view of the inward aspect of an exemplary embodiment of segments of a pontoon shield that mate to one another via coupling elements.

With reference to FIGS. 3A through 3C, multiple segments of a pontoon shield may be mated together with coupling elements 300, for example, having ridges 302 configured be seated in corresponding grooves 304 located on the inward surface of the segment. Such coupling elements provide an inter-locking connection between the segments, which may reinforce the connections between segments. For example, the couplings may be effective to prevent the segments from moving relative to one another once attached to a pontoon. The coupling elements may be formed from or reinforced with a substantially inductile material such as those disclosed herein.

Segments of a pontoon shield may be provided in various lengths so as to accommodate a variety of pontoon lengths. In some embodiments, a mid-segment 208 may be provided in a sufficiently long length to accommodate multiple pontoon lengths, which mid-segment may then be cut to size during installation. In some embodiments, two or more mid-segments 208 may be mated with one another to form a shield having a desired length. Such mid-segments may be provided in a variety of lengths, such that when configuring a pontoon shield, mid-segments may be selected from among a combination of various lengths so as to provide a pontoon shield having an overall desired length corresponding to a specified pontoon for which the shield segments are intended to be installed. For example, mid-segments for a pontoon shield may be provided having a length ranging from about 1 to 30 feet long, e.g., about 4, 6, 8, 10, 12, 14, 16, 18, 20, 22, 24, 26, 28, or 30 feet long, or any intermediate, smaller, or greater length.

Figure 4C:
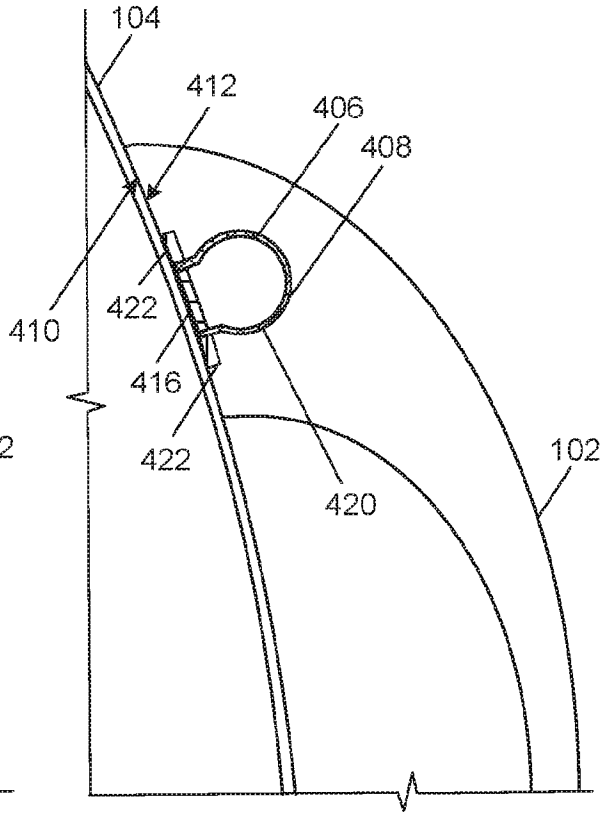
FIGS. 4A-C are cross-sectional views of exemplary embodiments of attachment means for a pontoon shield or segments thereof.
Figure 4B:
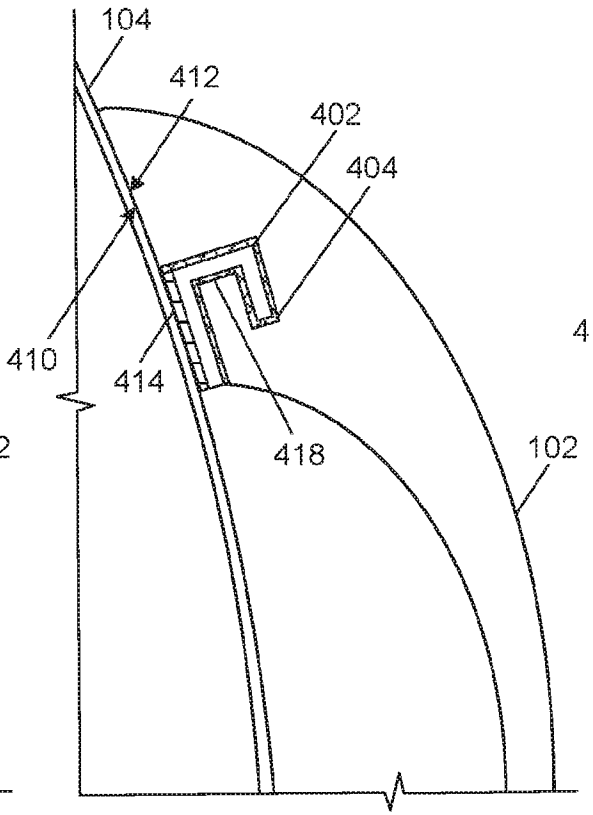
Figure 4A:
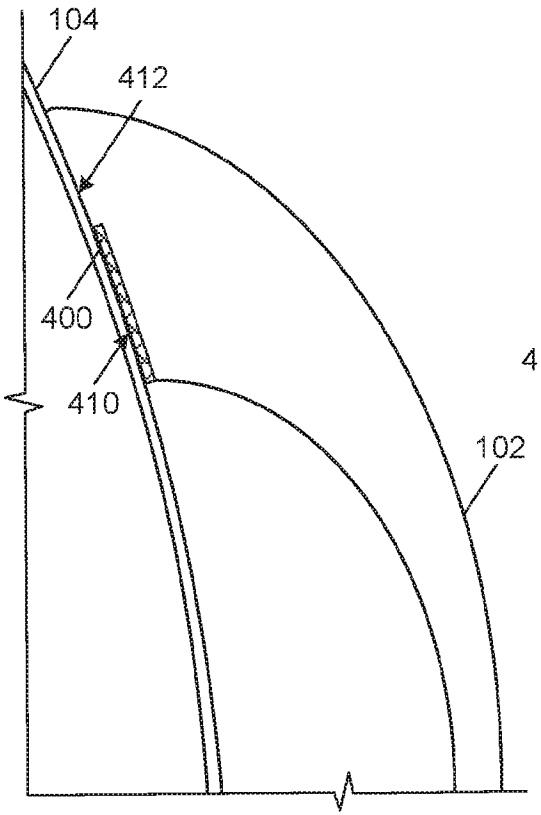

With reference to FIGS. 4A-C, partial cross-sections of pontoon shields installed on a pontoon are shown. The pontoon shields disclosed herein may be attached to a pontoon by any variety of means, including adhesives, bolts, brackets, other hardware, or combinations thereof. The particular attachment means selected for a given pontoon shield will depend on the desired characteristics for the shield and the type and application of the pontoon to which the shield is intended to be attached. Where an aesthetic appearance is desired, a pontoon shield may be attached in a manner which conceals the attachment means from plain view. Conversely, for pontoons intended for use in industrial or heavy-duty applications, accessible attachment means may be desirable, for example, to replace or repair a damaged segment or even an entire pontoon shield. In some embodiments, an industrial look of plainly visible attachment means may itself provide an aesthetic appeal.

As shown in FIG. 4A, a pontoon shield 102 or segments thereof may be attached to a pontoon 104 by means of an adhesive 400. Exemplary adhesives include polyurethane adhesive such as 3M™ Marine Adhesive Sealant 4200 or 5200, available from 3M, St. Paul, Minn. or double-sided acrylic tape, such as "high bond" tape available from Essentra PLC, Forest Park, Ill. or POWERGRAB® tape available from Henkel Corporation, Rocky Hill, Conn. The adhesive may be applied upon all or a portion of the pontoon shield's contact surface 410. In some embodiments, for example, as shown in FIG. 4A, adhesive may be omitted from the leading edge of a pontoon shield's contact surface, and such leading edge may be configured to tightly contact the adjoining surface of the pontoon, so as to form a seal 412 which may be effective to prevent water or other outside elements from penetrating between the pontoon shield and the wall of the pontoon. Such a seal may protect the adhesive from the elements, and/or prevent water from accumulating between the pontoon shield and the pontoon.

In some embodiments, a pontoon shield or segments thereof may be attached to a pontoon by means of one or more brackets on the pontoon, or other mechanical means. FIG. 4B shows a pontoon shield attached to a pontoon via an L-shaped bracket 402 and, optionally, an adhesive 404. FIG. 4C shows a pontoon shield attached to a pontoon via a cylindrical bracket 406 and, optionally, an adhesive 408. Such brackets may also be provided having any other configuration capable of securing the shield to the pontoon, such as T-shaped, Y-shaped, or any shape having a flange configured to interlock with a channel.

Brackets may be secured to the surface of a pontoon by any suitable means, such as via a weld or adhesive 414, 416. Corresponding channels 418, 420 on the contact surface of a pontoon shield or segment thereof may be provided to receive the bracket. For example, the cross-sectional shape of the channel may be configured approximately in the shape of a cylinder, an L-shape, a T-shaped, or a Y-shaped, or any other shape corresponding to the shape of a bracket. The surface of the channel which contacts the bracket may be secured to the bracket via adhesive 404, 408; or such adhesive may be omitted and an interlocking contact between the bracket and the pontoon shield may be effective to secure the pontoon shield to the pontoon. When a pontoon shield is secured via channels 418, 420 and without an adhesive, the shield may be removable, for example, to facilitate maintenance or servicing, or to stow the shield when its use is not desired.

In some embodiments, the channel may be reinforced with a substantially inductile material, such as a material as disclosed herein. For example, a collar 422 may be provided to reinforce the contact point between the bracket and the pontoon shield. The collar may be formed from any suitable substantially inductile material, and may be, for example, co-molded with the pontoon shield material. The collar 422 may be any desired shape, and may be positioned about any desired area of the pontoon shield. For example, the shape and position of the collar may correspond to the shape and position of the channel or socket and the bracket to which the channel or socket is intended to be attached. In some embodiments, the collar may traverse all or any portion of the channel or socket, such as along or in proximity to the interface between the contact surface of the channel or socket and bracket to which the channel or socket is intended to be attached. The collar 422 depicted in FIG. 4C may have a longitudinal shape as corresponding to a channel or an annual shape as corresponding to a socket. In some embodiments a collar may be effective to reinforce the integrity with which a channel is secured about a bracket. In some embodiments, a pontoon shield or segments thereof may be attached to a bracket via bolts or other hardware, in addition or as an alternative to adhesives or brackets.

Figure 5A:
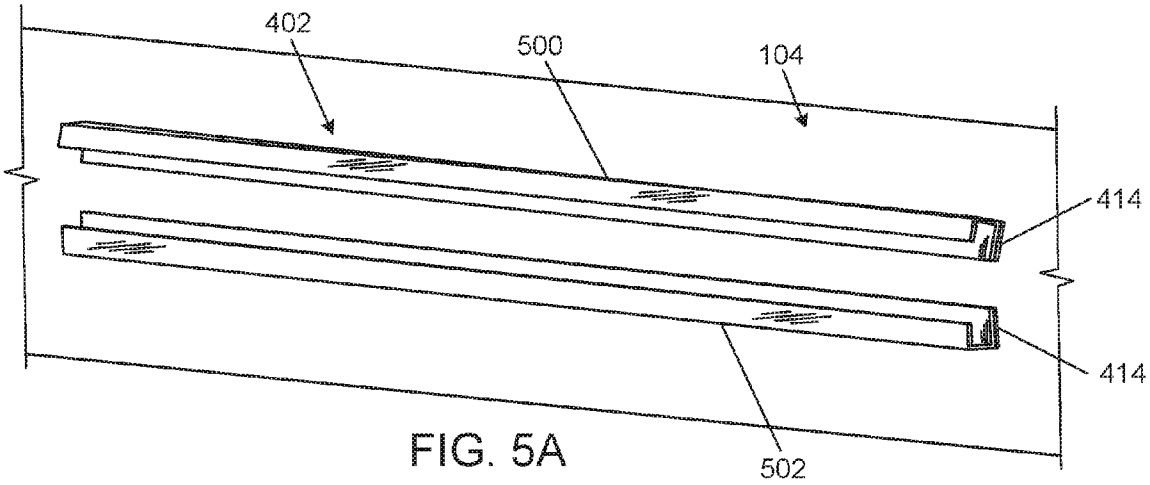
FIGS. 5A and 5B are perspective views of exemplary embodiments of brackets mounted on a pontoon for securing a pontoon shield to the pontoon.
Figure 5B:
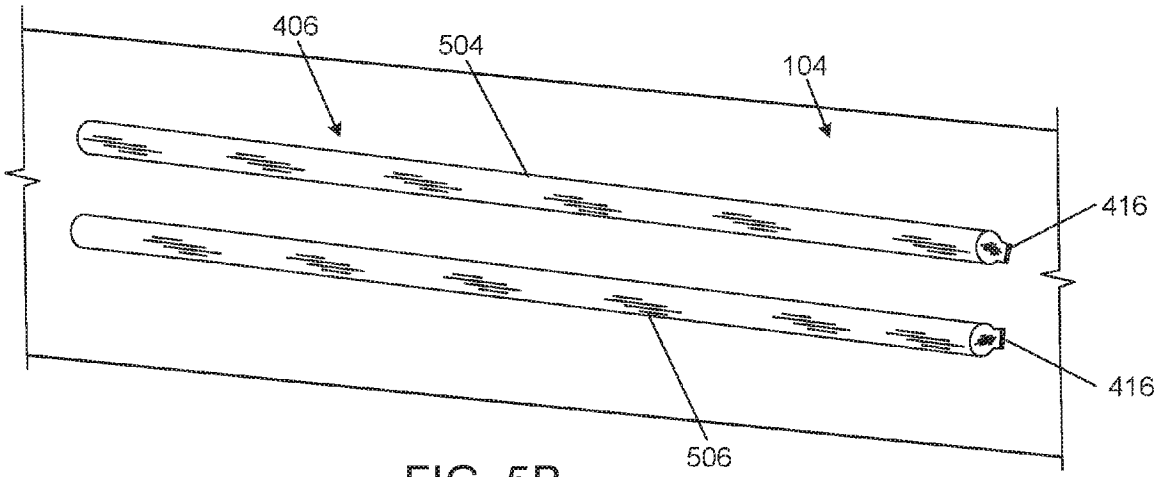
Figure 6A:
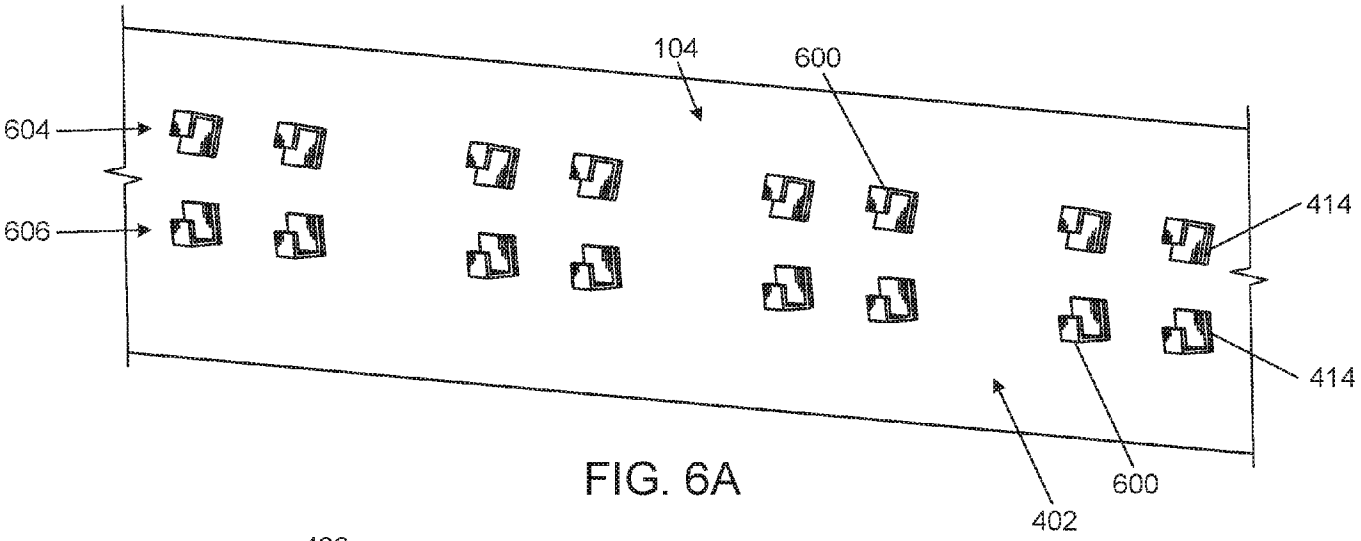
FIGS. 6A and 6B are perspective views of additional exemplary embodiments of brackets mounted on a pontoon for secured a pontoon shield or a segment thereof to a pontoon.
Figure 6B:
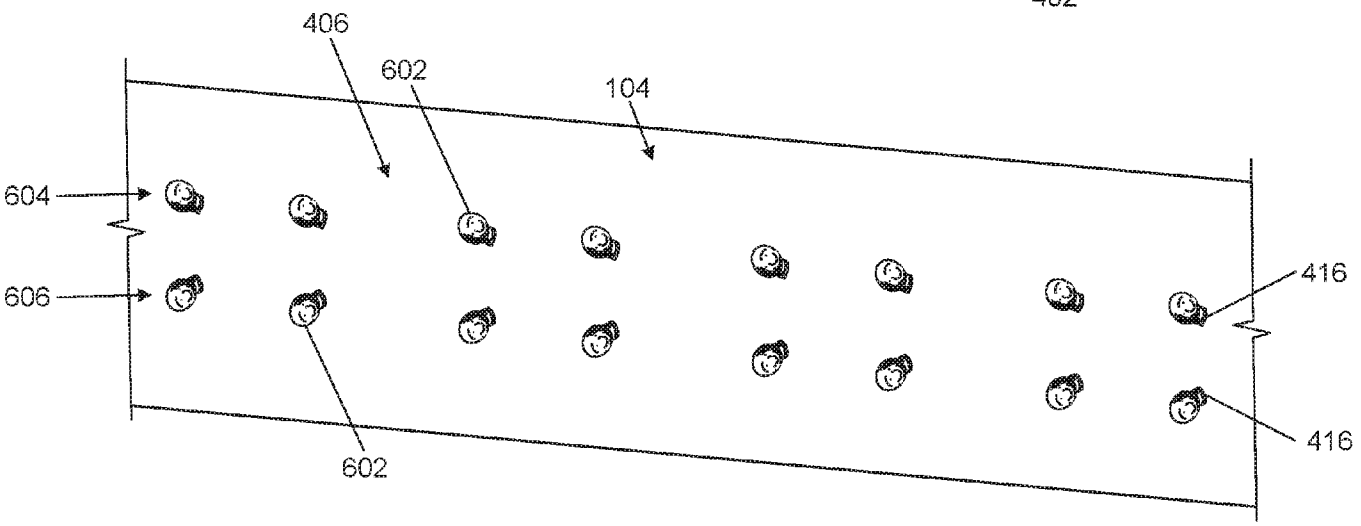

In some embodiments, as shown in FIGS. 5A and 5B, one or more brackets 402, 406 may be provided in the form of a rail. For example, a top rail 500, 504 and a bottom rail 502, 506 may be each configured to interlock with corresponding channels on the upper and lower contact surface of a pontoon shield, so as to secure the shield to the pontoon. Alternatively, as shown in FIGS. 6A and 6B, one or more individual brackets may be provided. For example, individual L-shaped brackets 600 or ball-shaped brackets 602 may be provided, each corresponding to a channel or a socket on the contact surface of a pontoon shield. For example, a top row of individual brackets 604 and bottom row of individual brackets 606 may be configured to interlock with corresponding channels or sockets on the contact surface of a pontoon shield so as to secure the shield to the pontoon. Sockets having other shapes may also be provided, such as any shape configured to interlock with bracket. As with a channel, sockets may be reinforced with a substantially inductile material. For example, a collar 422 may be provided to reinforce the contact point between the bracket and the pontoon shield.

Brackets for attaching a pontoon shield to a pontoon may be fashioned from any suitable material, such as a substantially inductile material. In some embodiments, brackets may be fashioned from metal, such as an aluminum alloy, which may be desirable for aluminum pontoons. Aluminum brackets may be attached to the surface of a pontoon via welds, adhesive, or other means 414, 416. Other metals such as stainless steel may also be used. Alternatively, brackets may be fashioned from substantially inductile polyurethane, polyethylene, polypropylene, or polyvinyl chloride, which brackets may be attached to a pontoon via adhesive or other means 414, 416. The one or more channels provided on the contact surface of a pontoon shield or segment thereof may be secured to the corresponding one or more brackets (e.g., 402, 406), for example, by sliding the channel of the shield onto the bracket such that the bracket passes through the length of the channel, or by snapping the channel onto the bracket.

In addition or as an alternative to brackets and/or adhesives, in some embodiments a pontoon shield may be attached to a pontoon via bolts and/or other hardware. For example, threaded bolts may be secured at various intervals along a longitudinal aspect of the pontoon. Corresponding holes may be provided in the pontoon shield or segments thereof to receive the bolts, and the shield or segments may be secured via nuts or other hardware.

The pontoon shields disclosed herein may be installed on a pontoon via any number of different installation processes. In some embodiments, pontoon shields may be installed as original equipment on factory-pontoons. Alternatively, pontoon shields may be provided as an after-market item, for example, for accessorizing a pontoon or for concealing existing damage, wear and tear, or repairs. Pontoon shields intended as original equipment or for professional aftermarket installation may utilize a more complex installation process (e.g., welding brackets to pontoons). Conversely, a more simple installation process, for example, adhesive tape, may be provided for pontoon shields intended to be self-installed by an average person. In some embodiments, pontoon shields or segments thereof may be cut to size from a length of material, for example, from a strip or a roll of material. In other embodiments, pontoon shields may be pre-fabricated to fit specified pontoon, or various segments may be selected and mated with one another.

Referring to FIGS. 7A-D, 8A-D, and 9A-D, several cross-sectional views show various embodiments of pontoon shields or segments thereof in accordance with the present disclosure. The pontoon shields shown in FIGS. 7A-D, 8A-D, and 9A-D are configured for attachment to a pontoon via an adhesive 700, 800, 900; however brackets and other attachment means may also be used together with or as an alternative to an adhesive in accordance with the present disclosure.

FIGS. 7A-D show exemplary embodiments of a pontoon shield or segment thereof having a substantially solid, low profile configuration. Such low-profile shields may be typically selected for applications requiring abrasion resistance, protection from punctures, and/or for concealing damage, wear and tear, or repairs to a pontoon; yet low-profile shields may also provide adequate impact-absorption in some embodiments. Low-profile shields or segments thereof may have a cross-sectional thickness at its mid-point ranging from about 0.1 inches to 3.0 inches; for example, the cross-sectional thickens of a low profile shield may be between about 0.1 to 1.0 inches, 0.125 to 0.5 inches, 0.5 to 1.0 inches, 1.0 to 2.0 inches, or 2.0 to 3.0 inches.

FIGS. 8A-D show exemplary embodiments of a pontoon shield or segment thereof having a concave inner surface 802 configured to form a concavity 804 defined by the adjoining surface of the pontoon. The concavity 804 allows the shield to deflect upon impact, thereby providing an enhanced cushioning effect to supplement the elastic properties of the shield. In some embodiments, the concavity 804 allows for the shield to be fashioned from a material having a lower degree of elasticity in favor of a greater degree of inductility while maintaining adequate impact-absorption properties. Since the shield may deflect into the concavity, a lesser portion of the impact need be absorbed by compression of the shield material. A concavity 804 may be provided in any shape, size or configuration. In some embodiments, the cross-sectional thickness of a pontoon shield or segment thereof between the shield's outer surface and the apex of a concavity may range from about 1% to 99% of the horizontal width of the pontoon shield at its widest point; for example, between about 5% to 10%, 10% to 20%, 20% to 50%, 50% to 75%, or 75% to 99%, of the shield's horizontal width.

In some embodiments, for example, as shown in FIGS. 8A-D, the cross-sectional thickness of a pontoon shield's material may gradually increase along a trajectory approaching the contact surface of the shield. Such a configuration may facilitate shields having a sufficiently thin cross-section at the leading edge of the shield to provide desired deflection upon impacts with objects, while also providing a sufficiently thick cross-section at the shield's contact surface to securely attach the shield to the pontoon. In some embodiments, such a gradually increasing cross-sectional thickness may be effective to provide energy absorption properties as the impulse from an impact travels radially through the shield.

FIGS. 9A-D show exemplary embodiments of a pontoon shield or segment thereof having one or more chambers 902 within the body of the shield or segment thereof. The chambers may serve a similar purpose as the concavity of FIGS. 8A-D, while in some embodiments also providing a relatively greater amount of shield material to absorb the force of an impact. A chamber 902 may be provided in any shape, size or configuration. In some embodiments, the horizontal cross-sectional thickness of a chamber may range from about 1% to 99% of the horizontal width of the pontoon shield at its widest point; for example, between about 5% to 10%, 10% to 20%, 20% to 50%, 50% to 75%, or 75% to 99% of the shield's horizontal width. The exemplary embodiments of FIGS. 9A-D may be typically selected for industrial applications, or other settings where sever impacts are expected, for example, where a lower profile or lighter-weight shield may be inadequate. However, low profile embodiments may also be provided having concavities and/or chambers in accordance with the present disclosure.

The pontoon shields disclosed herein may have an outward surface profile corresponding to any desired shape or combination of shapes. The outward surface profile may be selected to provide a desired aesthetic appearance and/or to serve various functional purposes. The cross-sectional profiles shown in FIGS. 7A, 8A, and 9A each have a curvilinear outward surface profile. A curvilinear outward surface may be effective to receive an impact at the leading edge of the shield's outer surface and then distribute the force of the impact radially along the shield. The cross-sectional profiles shown in FIGS. 7B, 8B, and 9B each have a substantially rectangular outward surface. A rectangular outward surface may be desired when a pontoon shield is intended to rest against another object. The leading edge of the shield may thus reside along a plane, thereby distributing the contact point with such other object across a larger surface area. A rectangular outward surface profile may be effective to reduce rocking or swaying of the pontoon relative to the object against which it is resting. In addition to a curvilinear or rectangular outward surface, other profiles may be provided in accordance with the present disclosure. For example, such other profiles may correspond to any desired shape or shapes or portions thereof, including curvilinear, circle, oval, quatrefoil, parallelogram, rectangle, trapezoid, triangle, rhomboid, pentagon, hexagon, heptagon, octagon, nonagon, or decagon.

Figure 7D:
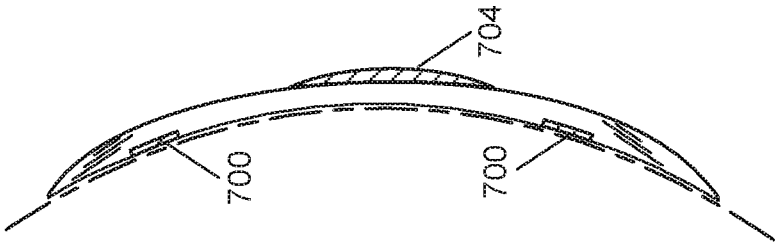
FIGS. 7A-D are cross-sectional views of exemplary embodiments of a pontoon shield or segment thereof.
Figure 7C:
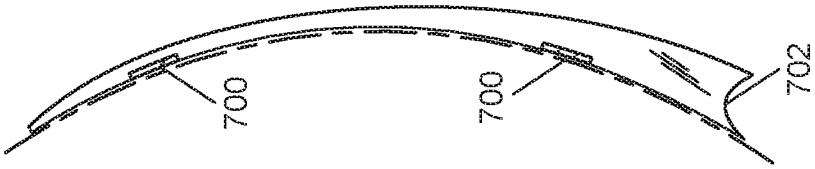
Figure 7B:
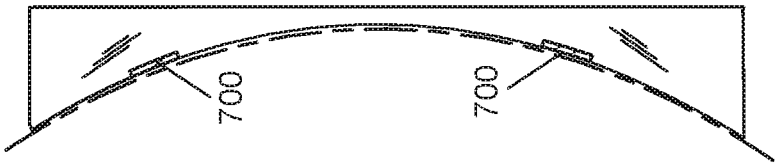
Figure 7A:
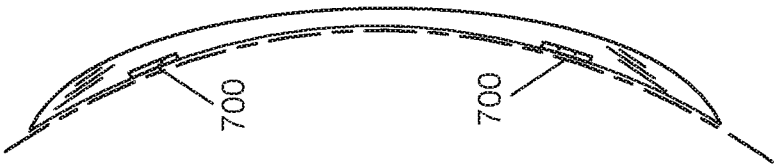
Figure 8D:
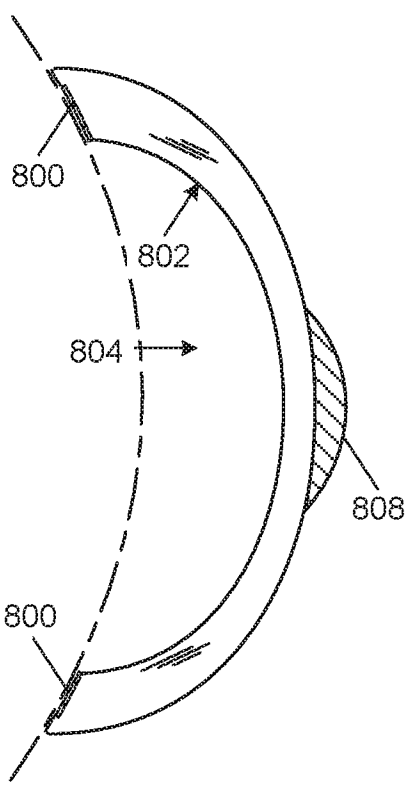
FIGS. 8A-D are cross-sectional views of additional exemplary embodiments of a pontoon shield or segment thereof.
Figure 8C:
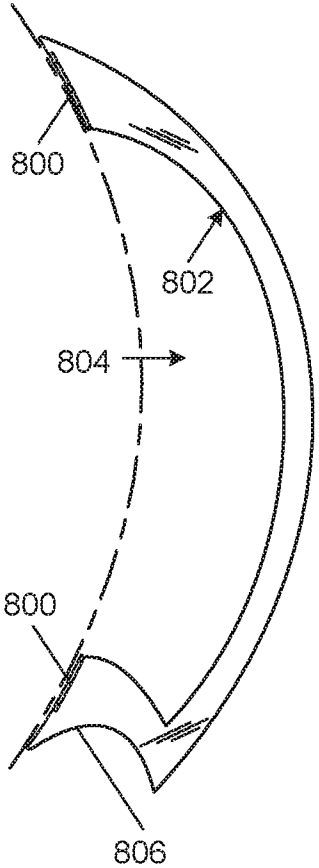
Figure 8B:
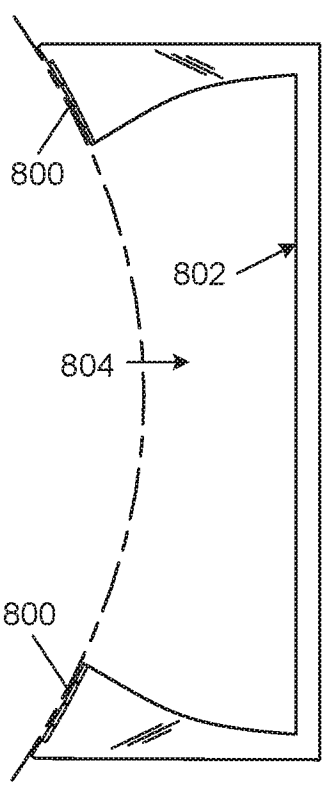
Figure 8A:
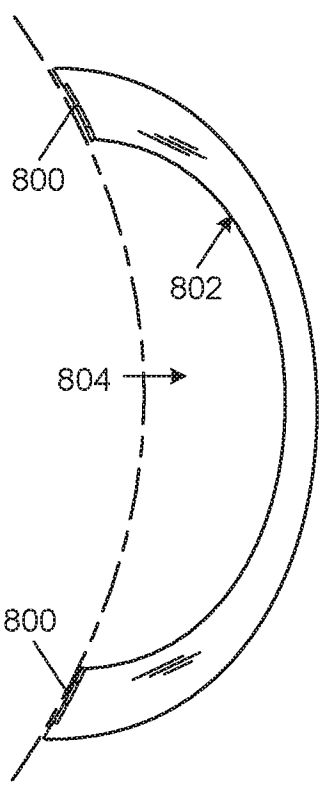

The cross-sectional profiles shown in FIGS. 7C-D, 8C-D, and 9C-D each also have a curvilinear outward surface profile, with the addition of a splash deflector 702, 806, 904 having a concave aspect configured to deflect splashing water. The splash deflector may be provided along all or any portion of the longitudinal aspect of a pontoon shield or segment thereof. As shown in FIGS. 7C, 8C, and 9C, the splash deflector is positioned along the lower, longitudinal aspect. In some embodiments, splash deflecting features may also be provided along other longitudinal aspects. For example, in some embodiments, one or more concave aspects or ridges may be aligned along a longitudinal aspect in a planar fashion. Although the splash deflector is shown in FIGS. 7C, 8C, and 9C on shields having a curvilinear cross-sectional outward surface profile, a splash deflector may also be provided in conjunction with any other shield profile.

The cross-sectional profiles of the pontoon shields of FIGS. 7D, 8D, and 9D each also have a curvilinear cross-sectional outward surface profile, with the addition of an abrasion resistant and/or substantially inductile material 704, 808, 906 that outwardly bisects the shield's resilient material. The abrasion resistant material may be effective to provide protection where the pontoon shield may be expected to scrape or rub against another object.

Figure 10:
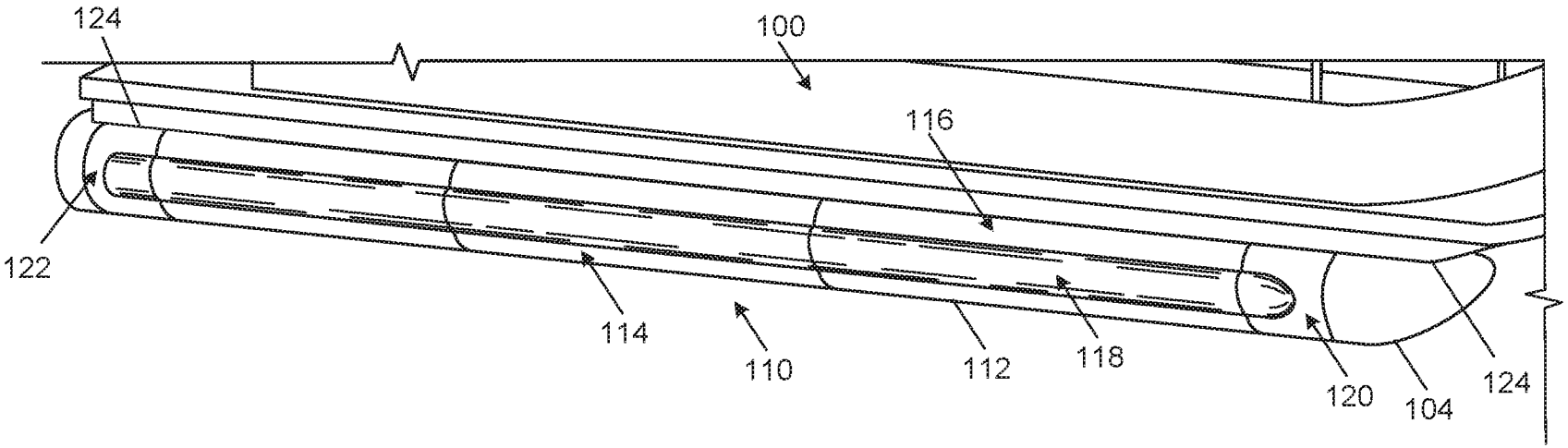
FIG. 10 is an exemplary embodiment of a pontoon shield having a skin aspect that wraps around a portion of the pontoon.
Figure 11:
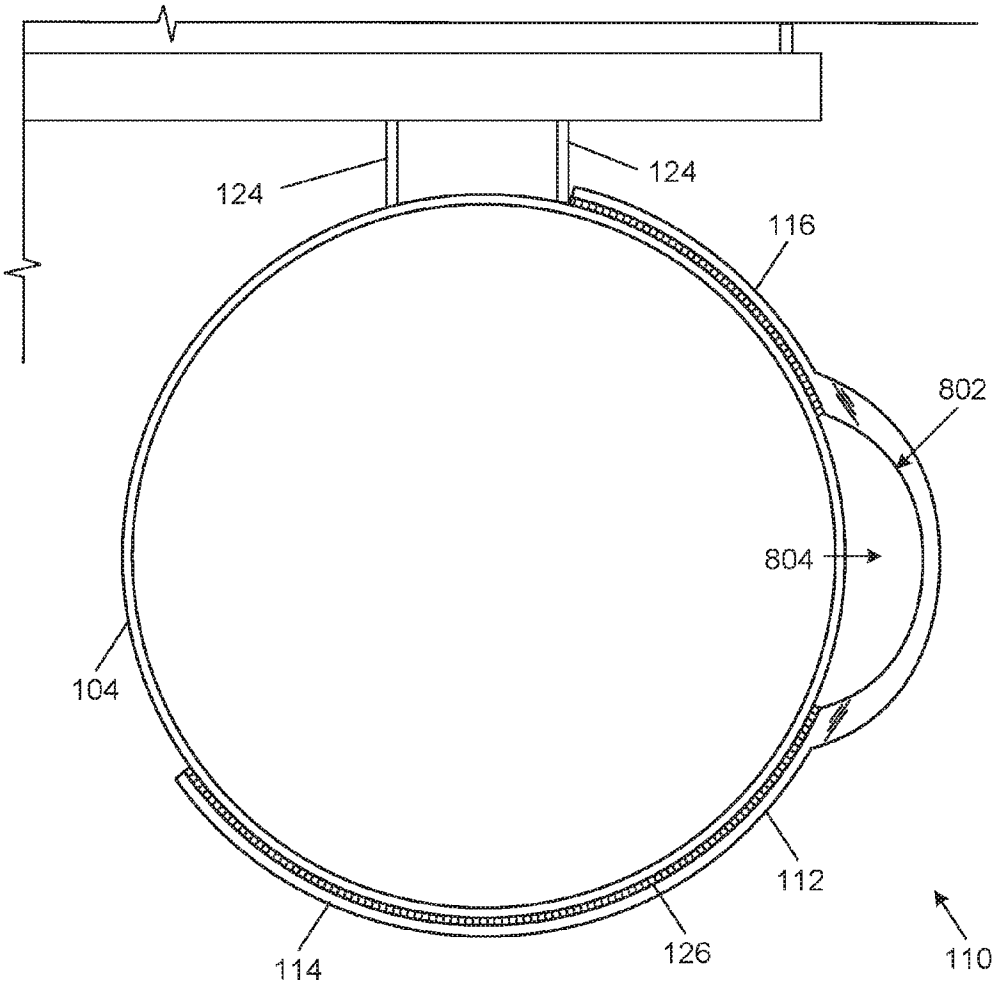
FIG. 11 is a cross-sectional view of the exemplary embodiment of FIG. 10.
Figure 12:
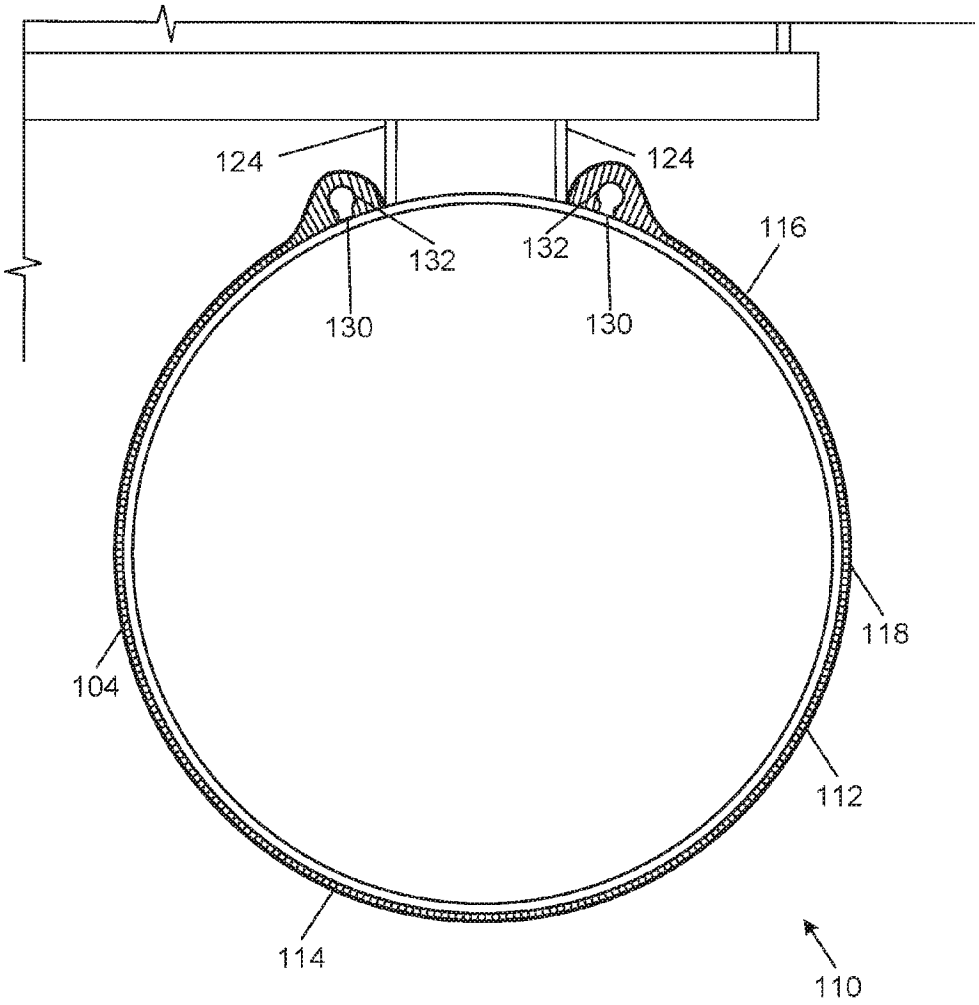
FIG. 12 is an additional exemplary embodiment of a pontoon shield having a skin aspect that wraps around the pontoon.

Referring now to FIGS. 10-12, in some embodiments, a pontoon shield 110 or segments thereof may comprise a skin aspect 112 configured to wrap around a portion of the pontoon 104. The skin aspect may comprise the entire portion of the pontoon shield or segment thereof, or the skin aspect may be integrated with any one or more other pontoon shield embodiments in accordance with the present disclosure. The skin aspect may be configured to wrap all or any portion of a pontoon. For example, the skin aspect may wrap a lower aspect 114, an upper aspect 116, a longitudinal aspect 118, a front aspect 120, a rear aspect 122, or any other aspect of a pontoon. In some embodiments, a pontoon shield having a skin aspect may be provided to wrap a substantial portion of a pontoon. In some embodiments, it may be unnecessary to wrap an entire pontoon, for example, where a portion of the pontoon is obscured from access such as by deck mounts 124, or when a particular aspect of a pontoon is not expected to sustain impacts with other objects.

As shown in FIG. 10, the skin aspect 112 may be integrated with a shield having a curvilinear cross-sectional profile. As shown in FIG. 11, the skin aspect 112 may be integrated with a shield having a curvilinear cross-sectional profile and a concave inner surface 802 configured to form a concavity 804 defined by the adjoining the surface of the pontoon. As shown in FIG. 12, a pontoon shield or cross section thereof may have a skin aspect that wraps around a longitudinal aspect 118 of the pontoon.

The skin aspect 112 may be attached to a pontoon via an adhesive 126, or any other attachment means or combinations thereof. In some embodiments, a bracket may be provided for attaching the skin aspect to the pontoon. As shown in FIG. 12, brackets 130 allow the shield 110 to be attached to the pontoon by sliding a channel 132 onto each of the brackets such that the brackets pass through the length of the channels, or by snapping the channels onto the brackets. When so attached without any adhesive, the shield 110 may be subsequently removed from the pontoon by peeling the channels off from the brackets. Such removability may facilitate maintenance or servicing, or the ability to stow the shield when its use is not desired. A shield having a skin aspect that wraps a lower aspect of a pontoon may be installed for use in shallow water, thereby protecting, for example, a lower aspect 114 of the pontoon from scrapes or dents. While brackets 130 are shown in FIG. 12 as having a circular shape, other bracket shapes may also be used, such as those disclosed herein, without departing from the spirit and scope of the present disclosure.

A skin aspect 112 may be fashioned from the resilient materials disclosed herein, e.g., elastomers, natural or synthetic rubbers, polymers, ceramics, or plastics. For example, exemplary materials for a skin aspect include polyurethane or polyvinyl chloride fabric, or elastomer-coated or plastic-coated fabrics, such as chlorosulfonated polyethylene synthetic rubber. The thickness of a skin aspect of a pontoon shield may range from about 0.8 mm to 5 mm, for example, between about 0.8 to 1.2 mm, 1.2 to 3 mm, or about 3 to 5 mm. In some embodiments, fabrics ranging from 800 denier to 2000 denier may be used for fashioning a pontoon shield comprising a skin aspect.

OTHER EMBODIMENTS

The foregoing detailed description of exemplary embodiments has set forth various embodiments of pontoon shields. While the pontoon shields disclosed herein are characterized by their applicability to pontoons, it will be apparent that numerous aspects disclosed herein also apply to other settings. For example, in addition to pontoons, in some embodiments, the shields disclosed herein may be applied to the hull of virtually any watercraft or vessel, such as where protection from impacts and/or concealment of existing damage, wear and tear or repairs are desirable. Where vessels have a flared, outward slanting, or curved hull, the gunwale and/or knuckles along a hull may provide some protection from impacts with other objects since the gunwale and/or knuckles may serve as a leading edge that receives an impact. Even so, the sides of a hull remain exposed to impacts from objects closer to the waterline or that may extend beneath the outfall of the hull or beyond the leading edge of the gunwale and/or knuckles. Accordingly, the shields disclosed herein may be applied along a longitudinal aspect of a boat hull. Similarly, the shields disclosed herein may conceal existing damage, wear and tear or repairs to virtually any watercraft or vessel, or the shield may itself exhibit an aesthetic characteristic that enhances the appearance of a watercraft or vessel.

The shields disclosed herein may be positioned at any impact-prone location of a hull, for example, at about the location where docks, pilings, watercraft, trailers, and other objects may likely impact the hull. In some embodiments, the shields disclosed herein may be positioned along the topsides of a hull; for example, such that the lower edge of the shield is positioned at, above, or below the waterline of the hull. The shields disclosed herein may be positioned along a leading edge, such as a gunwale or knuckle of a hull; or the shields may be positioned above or below a leading edge of the hull, for example to protect the hull from impacts with objects that extend beyond such leading edge. The shields disclosed herein may also be configured to provide protection for a bow and/or stern aspect of virtually any watercraft or vessel.

In some embodiments, the shields disclosed herein may comprise a skin aspect configured to wrap around all or a portion of the hull of virtually any watercraft or vessel. The skin aspect may comprise the entire portion of the shield or segment thereof, or the skin aspect may be integrated with any one or more other shield embodiments in accordance with the present disclosure. The skin aspect may be configured to wrap all or any portion of a hull. For example, the skin aspect may wrap a lower aspect such as a chine, keel, skeg, or any portion of the hull's surface between the waterline and any of those; an upper aspect such as a gunwale or knuckle; a longitudinal aspect such as a topside aspect, or any portion of the hull's surface between the gunwale and the waterline; a front aspect such as a bow; a rear aspect such as a stern, or any other aspect of a hull.

While various aspects and embodiments have been disclosed herein, other aspects and embodiments will be apparent to those skilled in the art. The various aspects and embodiments disclosed herein are for purposes of illustration and are not intended to be limiting. It is intended that the scope of this disclosure be defined by the following claims and their equivalents:

What is claimed is:

1. A pontoon shield comprising:

an elongated arcuate elastomeric strip, the strip having a curvilinear body that terminates in a pair of edge surfaces, the body having, a curvilinear outer surface, and a concentric curvilinear inner surface, the inner surface defining a curve and the space between inner corners of the edge surfaces defining a chord connecting end points of the curve;

each of the edge surfaces being disposed at an angle with respect to the chord, such that the edge surfaces are configured to be adhered to an outer arcuate surface of a pontoon, along a longitudinal aspect of the pontoon, without distorting the arcuate shape of the elastomeric strip.

2. The pontoon shield of claim 1, wherein the elastomeric strip is formed of a natural or synthetic rubber to allow the shield to resiliently deflect upon impact and return to its original shape after impact.

3. The pontoon shield of claim 1, wherein the edge surfaces carry an adhesive configured to seal the outer edges to the outer surface of the pontoon so as to form a seal effective to prevent water from penetrating between the shield and the pontoon into the chamber.

4. The pontoon shield of claim 3, wherein the adhesive is provided in the form of an adhesive tape.

5. The pontoon shield of claim 4, wherein the adhesive tape comprises acrylic tape.

6. The pontoon shield of claim 1, wherein the elastomeric strip has a cross-sectional thickness from 0.8 mm to 5 mm thick.

7. The pontoon shield of claim 1, wherein the elastomeric strip measures between 3 to 5 inches wide.

8. The pontoon shield of claim 1, wherein the cross-sectional thickness of the elastomeric strip is from 0.1 to 1.0 inches.

9. The pontoon shield of claim 1 further comprising one or more brackets configured to attach the elastomeric strip to the outer surface of the pontoon.

10. The pontoon shield of claim 9, wherein the elastomeric strip comprises a channel or a socket configured to receive one of the one or more brackets.

11. The pontoon shield of claim 10, wherein the cross-sectional shape of the channel or the socket comprises a circle or an L-shape.

12. The pontoon shield of claim 1, wherein the elastomeric strip is reinforced with a substantially inductile material.

13. The pontoon shield of claim 12, wherein the substantially inductile material outwardly bisects the elastomeric strip, providing abrasion resistance.

14. The pontoon shield of claim 1, wherein the elastomeric strip comprises an outer surface having a splash deflector.

15. The pontoon shield of claim 1, further comprising a front segment and a rear segment at opposite ends of the length of the elastomeric strip, wherein the front segment and rear segment are formed integrally with the elastomeric strip.

16. The pontoon shield of claim 1, further comprising a front segment and a rear segment at opposite ends of the length of the elastomeric strip, wherein the front segment and rear segment are joined to the elastomeric strip.

17. The pontoon shield of claim 16, wherein the front segment and rear segment are mated to the elastomeric strip with interlocking couplings.

18. The pontoon shield of claim 1, wherein the elastomeric strip comprises a plurality of segments, mated together by coupling elements.

* * * * *